United States Patent [19]

Scelzi

[11] 4,194,085

[45] Mar. 18, 1980

[54] FINGER KEYER FOR CODE TRANSMISSION

[76] Inventor: Joseph I. Scelzi, P.O. Box 600-710, North Miami Beach, Fla. 33160

[21] Appl. No.: 942,912

[22] Filed: Sep. 14, 1978

[51] Int. Cl.[2] ..... H01H 21/86

[52] U.S. Cl. ..... 178/101

[58] Field of Search ..... 178/101–110; 400/479, 485, 474, 477, 87, 88; 340/407; 35/6

[56] References Cited

U.S. PATENT DOCUMENTS

| | | | |
|---|---|---|---|
| 3,022,878 | 2/1962 | Seibel et al. | 400/479 |
| 3,507,376 | 4/1970 | Kafafian | 178/101 |

*Primary Examiner*—Thomas A. Robinson

*Attorney, Agent, or Firm*—Clarence A. O'Brien; Harvey B. Jacobson

[57] ABSTRACT

A telegraphic keyer fitting over a finger, preferably the index finger, of an operator, is disclosed for tapping against the operator's thumb or any convenient object in practice or transmission of code with portable equipment. The keyer is useful when walking, sitting, standing, driving, or during other activities of the operator.

6 Claims, 4 Drawing Figures

Fig. 1
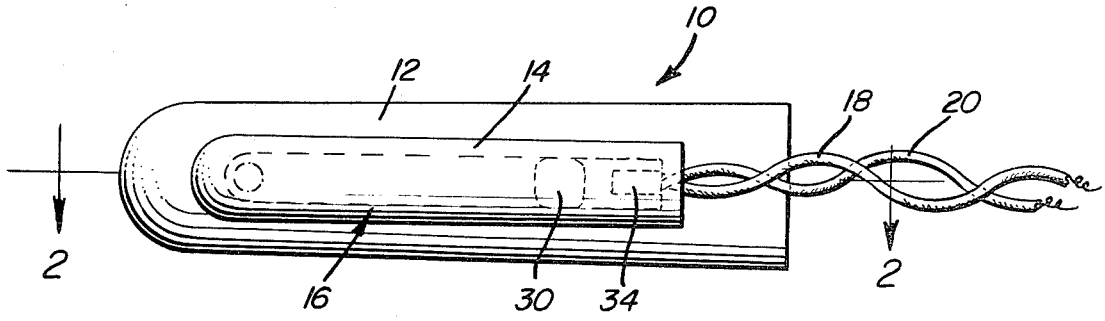
Fig. 2
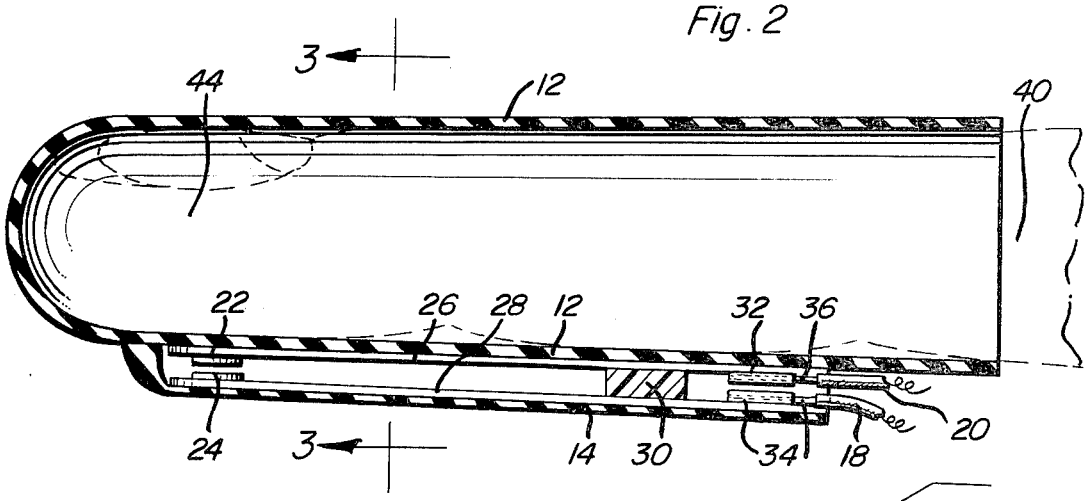
Fig. 3
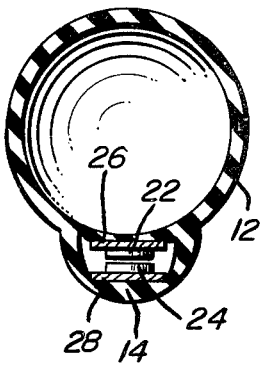
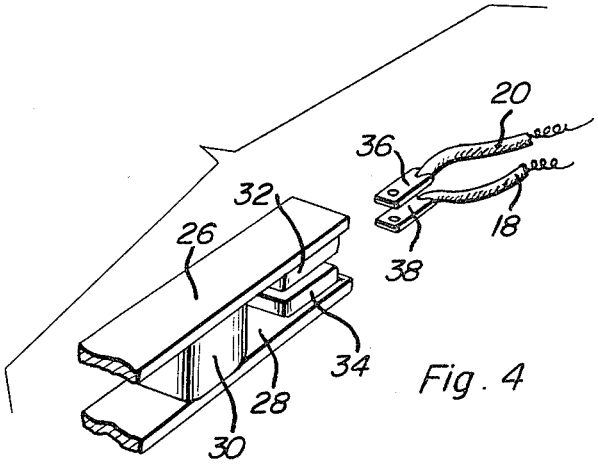
Fig. 4

FINGER KEYER FOR CODE TRANSMISSION

BACKGROUND OF THE INVENTION

1. Field of the Invention

The invention relates to a device for formation of code, such as Morse code, Naval code, or similar codes, such as are made up of dots and dashes. The device comprises a keyer fitting over an operator's finger and permitting contact points to alternately open and close an electrical circuit, permitting practice or transmission of code with portable equipment.

2. Description of the Prior Art

Finger keyers at fixed location for transmission of telegraphic code are known, where opening and closing of electrical contact points causes a coded sequence of electrical impulses which with appropriate sensing equipment can be used to transmit verbal information.

The prior art also contains reference to code practice devices, such as U.S. Pat. No. 3,125,752, issued Mar. 17, 1964, to Burns, showing a sound generating electro-acoustical device for reproducing the sound of a high frequency radio signal for code practice, and U.S. Pat. No. 2,935,564, issued May. 3,1960, to Burns, Jr., shows an educational code device. A portable telegraphic instrument for carrying on the body of the operator is taught by Zelenka in U.S. Pat. No. 868,621, issued Oct. 15, 1907, showing a wrist-mounted telegraphic instrument for receiving messages and, with cooperation of the opposite hand, for sending messages.

None of the prior art cited above, however, discloses use of a keyer attached to an operator's finger and useful for practice or transmission of code independent of the other hand.

SUMMARY OF THE INVENTION

It is an object of the invention to provide a keyer for code transmission mounted on the finger or thumb of an operator and permitting practice or transmission of code by movement of the digit upon which the device is mounted.

Another object of the invention is to permit practice or transmission of code by portable equipment carried on or near the person of the operator.

Still another object of the invention is to provide a portable device for practice or transmission of code by persons having the use only of one hand, such as handicapped persons or persons who are otherwise occupied, such as in standing, sitting, walking, driving or other activities.

Yet another object of the invention is to enable telegraphic operators who may be deaf or blind to practice and transmit telegraphic code in the capacity of keyer operator.

A further object of the invention is to provide a self-contained telegraphic finger keyer usable in corrosive, aqueous or other adverse environments, such as under water during fresh or salt water diving, during cleaning of the interior of railroad tank cars, and similar circumstances.

These and other objects are obtained by use of a flexible material tubing fitting over the finger or thumb of the operator and containing on its outside a keyer mechanism sealed to the tubing in a hollow cavity. Contact points within the cavity are opposably disposed on parallel lengths of spring metal, each contact point being in electrical connection with feed wire lines forming a part of the code practice set or transceiver, which is conventional and forms no part of the novel features of the present invention. The digit on which the keyer is held is pressed against a solid object, such as a work surface, chair, steering wheel, another digit, or the like, causing the contact points to touch and closing an electrical circuit. As pressure is removed, the points separate, thereby opening the electrical circuit. Standard telegraphic signals, such as dots and dashes or Morse code, Naval code, and the like, can thereby be formed, enabling the operator to practice or transmit coded information.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a bottom plan view of the finger keyer of the present inventicn, showing the flexible material inserted over an operator's digit, as well as the hollow cavity attached thereto and sealingly enclosing the keyer device shown in phantom.

FIG. 2 is a longitudinal sectional view of the device of FIG. 1, taken substantially upon a plane passing along section line 2—2 on FIG. 1.

FIG. 3 is a transverse sectional view of the device of FIG. 2, taken substantially upon a plane passing along section line 3—3 on FIG. 2.

FIG. 4 is a group perspective view of the electrical contact points for making a wire connection with the finger keyer mechanism held in the hollow cavity of the device.

DESCRIPTION OF THE PREFERRED EMBODIMENT

The finger keyer, designated generally by the numeral 10 in FIG. 1, comprises a flexible material sheath 12 for receiving a finger or thumb of the operator of device 10, hollow cavity 14 for receiving the keyer mechanism 16 of the device, and wires 18 and 20 for completing an electrical circuit with a conventional code practice set or transceiver (not shown). Keyer mechanism 16 comprises contact points 22 and 24, respectively held on spring metal supports 26 and 28, which are fastened respectively to sheath 12 and cavity 14 by a glue or adhesive, such as an epoxy glue. Alternatively, spring metal supports 26 and 28 can be fastened mechanically, such as with staples, interfitting support strips, or other suitable fastening means.

Insulator 30 separates spring metal supports 26 and 28 mechanically and electrically, and prevents contact of connectors 32 and 34, which receive pins 36 and 38 attached, and preferably soldered, to wires 20 and 18, respectively. Pin 36 is insertable in connector 32 and pin 38 is insertable in connector 34, respectively, making electrical connection with spring metal support 26 and spring metal support 28. Wires 18 and 20 are insulated in a conventional manner with a material resistant to the environment within which use of the device is contemplated. Accordingly, if use in an aqueous environment, such as sea water or the like, is expected, the insulation on wires 18 and 20 will be water resistant and resistant to any chemicals expected to be encountered during use of the device.

In operation, the device is conveniently placed over the index finger 40 of the operator, as shown in FIG. 2. When the tip of the finger 44 is pressed downwardly in the view shown in FIG. 2, pressure on the undersurface of flexible cavity 14 causes spring metal supports 26 and 28 to flex so as to permit contact points 22 and 24 to move toward each other and come in physical contact. At the moment of physical contact, electrical contact is also established, causing a flow of current through the connected elements between the transceiver or code practice set connected to wires 18 and 20, through insulated wire 20, connected in sequence to pin 36, connector 32, spring metal suport 26, contact point 22, contact point 24, spring metal support 28, connector 34, pin 38 and insulated wire 18. As pressure is released by finger tip 44, contact points 22 and 24 separate due to the resilience inherent in spring metal supports 26 and 28, causing the electrical and mechanical contact between contact points 22 and 24 to be broken. This opens the electrical circuit which has been established by contact of the contact points 22 and 24. The sequence of contact and release results in patterns, such as dots and dashes, which make up a code such as the conventional Morse code or Naval code.

In the event that use in a corrosive environment is contemplated, such as sea water, chemicals encountered during use, or otherwise, wires 18 and 20 can be sealed at the entrance to hollow cavity 14. Alternatively, pins 36 and 38 as well as connections 32 and 34, and spring metal supports 26 and 28 can be constructed of a non-corrosive material, such as stainless steel, and insulator 30 can sealingly present admission of corrosive against into the interior portion of hollow cavity 14 which encloses contact points 22 and 24. In this manner, an electrical short is prevented in this region.

The keyer 10 is useful when the operator is occupied in routine activities, such as walking, sitting, or just standing and even while driving. Code can be practiced or transmitted with portable equipment attached or carried on the person of the operator. When the keyer 10 is attached to the index finger, tapping against the thumb by pressing hollow cavity 14 against the tip of the thumb near the region below contact 24 is conveniently accomplished by the operator when otherwise occupied.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A keyer device for manual coded electrical signal production for code practice or transmission by an operator comprising removable wearing means insertible over a digit of the operator and signal producing means attached to said wearing means for production of said coded electrical signal in the form of dots and dashes, wherein said signal producing means comprises an elongated flexible hollow cavity attached to and independent of said wearing means, said cavity enclosing a keyer mechanism for alternate opening and closing of an electrical circuit, wherein said wearing means comprises a flexible sheath into which said digit is insertible, said keyer mechanism in the cavity being operable by manual pressure exerted on the keyer mechanism by said digit forcing the cavity against a solid object, whereby the closing of the electrical circuit is effected by said manual pressure, and the opening of the electrical circuit is effected by release of said manual pressure.

2. The device of claim 1 wherein said keyer mechanism in the cavity comprises a pair of resilient spring metal supports sealingly separated by an electrical insulator and attached thereto having a pair of opposed contact points for opening and closing said electrical circuit, whereby admission of corrosive agents into the cavity is preventable.

3. The device of claim 2 wherein said keyer mechanism comprises in addition a pair of connectors, each of which is attached to the end of a spring metal support remote from the contact point thereon.

4. The device of claim 3 wherein said sheath is rubber and said digit is the index finger of the operator.

5. The device of claim 1 wherein the cavity is a straight elongated flexible tube extending generally parallel to and anteriorly along the digit enclosed within the flexible sheath, a portion of the sheath constituting one wall of the tube, the keyer mechanism comprising a pair of contact points and a pair of elongated spring metal supports, each contact point being held on one of the pair of elongated metal supports, a first of the elongated supports extending generally parallel to the digit within the cavity and being fastened to the sheath forming a wall of the tube with the first contact point on the first support being located near the distal end of the cavity, the second of the elongated supports being disposed subtantially parallel to the first support and fastened to the tube in spaced relation therefrom, the second contact point of the second support being located near the distal end of the cavity and opposite the first contact point on the first support, the pair of substantially parallel supports being separated mechanically and electrically by an insulator at the ends of the supports remote from the contact points, the supports being flexible and electrically conductive to permit the contact points to reversibly remove toward each other and come into physical and electrical contact, each support being connected to a connector attached to a pin soldered to wires carrying the coded electrical signal.

6. A method of operating the device of claim 3 comprising the following steps:

(a) inserting said digit into said sheath;
(b) placing said hollow cavity upon a solid object;
(c) applying pressure from said digit sufficient to flex said spring metal supports and place said contact points in physical and electrical contact;
(d) holding said contact points in physical and electrical contact for a predetermined time;
(e) releasing pressure from said digit; and
(f) repeating the steps above in a coded sequence.

* * * * *